US006085439A

United States Patent [19]

Skaarup

[11] Patent Number: 6,085,439

[45] Date of Patent: Jul. 11, 2000

[54] APPARATUS FOR AIRING GRAINS STORED IN BULK

[75] Inventor: Juan Carlos Skaarup, Necochea, Argentina

[73] Assignee: Haletec S.A., Buenos Aires, Argentina

[21] Appl. No.: 09/054,774

[22] Filed: Apr. 3, 1998

[51] Int. Cl.[7] ..... F26B 19/00

[52] U.S. Cl. ..... 34/225; 34/233

[58] Field of Search ..... 34/218, 224, 225, 34/231, 233

[56] References Cited

U.S. PATENT DOCUMENTS

| | | | |
|---|---|---|---|
| 2,733,521 | 2/1956 | Zollman | 34/224 |
| 3,531,874 | 10/1970 | Sukup | 34/225 |
| 4,257,169 | 3/1981 | Pierce | 34/27 |
| 4,306,490 | 12/1981 | Kallestad et al. | 98/55 |
| 4,412,392 | 11/1983 | Keller | 34/233 |
| 4,885,985 | 12/1989 | Pollock | 98/55 |
| 5,632,674 | 5/1997 | Miller, Jr. | 454/182 |

*Primary Examiner*—Henry Bennett
*Assistant Examiner*—Malik N. Drake
*Attorney, Agent, or Firm*—Dvorak + Orum

[57] ABSTRACT

An apparatus for airing grains stored in bulk on a floor of a depot, including a tunnel comprising a duct made of half cylindrical shaped corrugated sheets. The corrugations are approximately sine-wave shaped and provide adequate reinforcement for supporting the weight of grain stored on top. Aprons anchor the duct to the floor, and the duct is connected to a blower which supplies air to the duct. The duct has an inner surface, an outer surface, and two longitudinal edges, with each of the longitudinal edges extending substantially parallel to one another and bear on the respective aprons anchored to the floor. The duct is provided with air outlet openings for injecting air into the grain, wherein the openings are located adjacent or near the longitudinal edges of the duct. Each apron comprises a substantially horizontal wing for anchoring the apron to the floor, thereby forming an air channel between the floor and the inner surface of the duct. The duct longitudinal edges bear perpendicularly on the respective horizontal wing of each apron. A second wing of each apron extends perpendicular to the horizontal wing up to a level at least approximately equal to the level of the air outlet opening.

12 Claims, 3 Drawing Sheets

APPARATUS FOR AIRING GRAINS STORED IN BULK

FIELD OF THE INVENTION

This invention is related to storage of grains in depots, such as silos and sheds, and, more particularly, refers to an apparatus for airing the grain inside the depot.

BACKGROUND OF THE INVENTION

In farming, particularly in the field of industrialization and marketing of grains, it is common to store harvested grains in silos or depots before shipping to an intermediate destination (a port, for example) or to an end destination (a food processing facility). Storage times are pretty variable and dependent on different circumstances and may range from just a few days to several weeks or even months. Whatever the storage time, it is crucial that the quality of the grain be preserved so as not to spoil or ruin the food end-product manufactured therefrom.

Silos generally store large tonnages of grain and are likely places for radicating moisture because of the way it is stored in bulk therein. The grain already brings along a significant degree of moisture from the harvest, however it is desirable to store it as dry as possible for it to preserve. For this reason, big silos are equipped with means for airing the grains and keeping them in good and dry conditions, eliminating the moisture carried over from the harvest and protecting the grains at the storage site from moisture in the surrounding environment. Such means use fans for generating air currents, which are operated when the depot is full or partly full both for airing as well as to assist in discharging the grain by injecting air in the direction it is to be conveyed.

SUMMARY OF THE PRIOR ART

Such airing/drying means may comprise an apparatus in the form of channels installed as tunnels on the floor of the silo and provided with openings for blowing dry air currents towards the grain stored in bulk above. The air currents cool and dry the grain, detering the formation of localized regions of moisture and heat (hot-spots) in the product which would be capable of ruining it. The channels are anchored to aprons arranged on the floor and which include an inner wing which acts as a deflector inside the channel, so as to be able to operate with efficienter low-speed air streams in the channel and distribute the air homogenously and inject it at greater speed into the grain, in addition to containing the entry of bulk material into the channel.

In general, large depots and silos require a plurality of such channels linked to a common blower or fan by means of valves which direct the air and select areas for airing or unloading.

French patent N° 2,596,737 (Lagneau) is an example of a device for airing/drying silos comprising a channel or duct having a less than half-circular section made of corrugated sheets bolted or clamped to a slanted wing of an apron. The apron further has a horizontal wing imbedded or fixed to the concrete floor of the silo. The sheet corrugations define ribbings which provide structural reinforcement against the sheets collapsing under the weight of the grain. Air is blown through the duct and injected into the grain through openings formed along the edge of the sheet, right at the zenith of the sheet corrugations, manufactured by means of a simple L-shaped slit followed by lifting the cut potion of the sheet to form a deflector which is nearly parallel to the plane of the duct, to direct air in the conveyance direction of the grain.

Danish patents DK N° 1981/89 and DK N° 2770/89 (Degrolard) suggest another form of apparatus for the same object. The channel, necessarily of a less than half-circular section like the above-mentioned French patent, is made of vee sheets and floor anchorage is by means of aprons having an inwardly-inclined step on which the channel edges bear. The apron further features a horizontal wing outwardly of said step for fixing the same to the floor of the silo by means of bolts imbedded in the floor and a profiled wing extending inwardly of the step and upwardly inside the channel. The profiled wing features trapeze-shaped cross ribbing formed by stamping in correspondence with the reinforcing trapezoidal corrugations of the channel sheet to jointly provide air ducts through rectangular openings formed in one of the slanted sides of the sheet corrugations, proximate to the longitudinal edges of the channel, for conveying air at higher speed towards the grain in the grain conveyance direction. The profiled wings extend up to the top level of the openings to stop the grain from penetrating and spreading into the channel when the fan is turned off.

The apparatus of the Danish patents has the advantage that the apparatus may be disassembled when the depot is destined to a different use. However, the manufacture of the apron requires stamping operations to corrugate the sheets both longitudinally and transversally and to form the air outlet openings. Apart from complex and expensive, the need for special dies for manufacturing restricts the length of the aprons, thereby requiring a greater number of such parts. Moreover, when disassembled, all these parts need to be carted away and stored, occupying a substantial amount of room.

On the other hand, the apparatus of the forementioned French patent may not be disassembled, at least not that easily. In particular, only the tunnel may be disassembled and reassembled with a lot of work but leaving the aprons anchored to the floor. Furthermore, the deflectors of the injector openings are insufficient to stop all the bulk material from penetrating into the duct when the fan system is off.

SUMMARY OF THE INVENTION

An object of the invention is a bulk-stored grain airing apparatus which is simpler and more economical to manufacture, wherein the channel is manufactured from parts readily available on the market.

Another object of the invention is a bulk-stored grain airing apparatus using aprons which may be manufactured by means of folding machines.

A further object of the invention is a bulk-stored grain airing apparatus which is simple to disassemble and remove from the floor of the depot and which uses up less storage space.

Yet another object of the invention is a bulk-stored grain airing apparatus relatively quicker to assemble and which uses parts which are geometrically less complex without sacrificing efficiency and other requirements.

Yet a further object of the invention is a bulk-stored grain airing apparatus assembled from relatively long modules, wherein the module length is limited only by the width of the folding machine used for manufacture thereof.

These and other objects and advantages are achieved with an apparatus for airing grains stored in bulk form on the floor of a depot. The apparatus comprises a channel or duct for location on the floor such that it is covered by the grain and forms an air channel between the floor and the inner surface of the duct. The duct has air outlet openings extending from the longitudinal duct edges. These edges bear flatly on respective aprons, each of which includes a substantially horizontal wing for anchoring to the floor. According to the invention, the duct is made of semicilindered sheet having transversal reinforcement corrugations, wherein the cross section of the channel is a half-circumference whereby the longitudinal edges of the duct bear perpendicularly on the respective horizontal wings of the aprons. This type of sheet enables using materials which are available already on the market, for example corrugated sheets used for channeling rain-water in street drainages. In turn, each apron comprises a second wing, also advantageously flat, which makes manufacture inherently feasible by means of a folding machine. This second wing extends vertically upwards to at least about the same level as the air outlet openings.

Preferably, the aprons may comprise a second longitudinal fold forming a third wing, which is also flat, projecting from the upper longitudinal edge of the second wing and extending in a slanted plane inwardly into the channel. The second wing, i.e. the middle wing, of the aprons contact the inner surface of the duct at the bottom of the corrugations to form therebetween a plurality of pressurized-air outlet openings which lead to the respective openings.

Advantageously, the openings are formed at the onset of each corrugation in the grain conveyance direction, by cutting a respective L-shape in the sheet and folding the cut portion out to project and form a deflector at a certain angle with the wall of the duct, preferably between 30° and 60° and, more preferably of about 45° or an angle at which the deflectors are approximately parallel to the complementary part of the corrugations.

SUMMARY OF THE DRAWINGS

The above-stated and other novel features and aspects of this invention and how it may be reduced to practice may be understood better from the following detailed description of a preferred embodiment shown in the attached drawings, wherein.

DETAILED DESCRIPTION OF A PREFERRED EMBODIMENT

Figure 1:
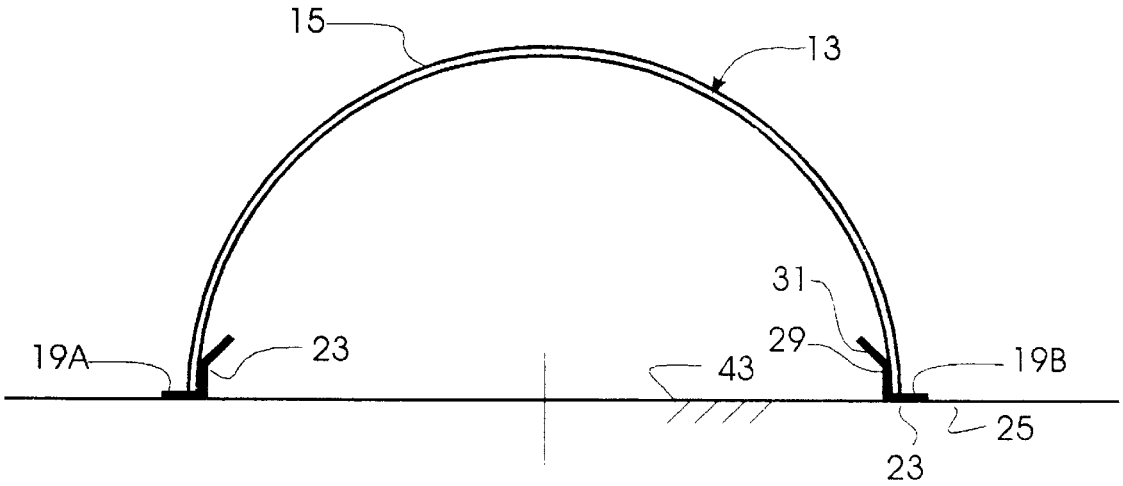
FIG. 1 is a cross section of an airing apparatus according to this invention.
Figure 2:
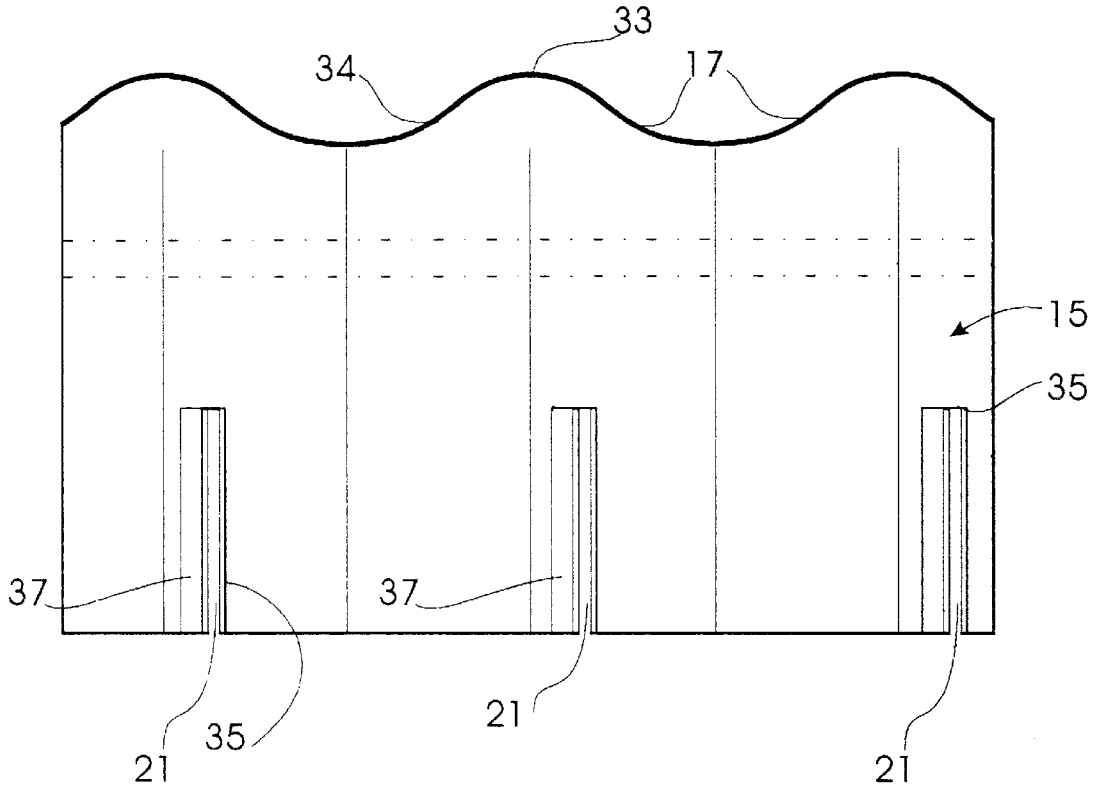
FIG. 2 is a side elevation view of a stretch of the apparatus of FIG. 1, showing the openings which inject air on the grain.

Referring to the drawings, FIGS. 1 and 2 show the grain airing apparatus 11 according to the invention. A tunnel 13 conveying low-speed air-streams comprises a duct made of corrugated sheets 15. The corrugations 17 are approximately sine-wave shaped and provide adequate reinforcement for supporting the weight of the grain stored on top thereof. The corrugated sheet 15 is cilindered so that its cross section is exactly semicircular between its two longitudinal edges 19A and 19B. Rectangular openings 21 are provided next to these edges 19 (alphabetical suffices are omitted herein where general references are indicated) for injecting air from the duct 13 towards the grain or material bulk-stored in the silo. This type of sheet has a diameter of from 500 to 2,000 mm and a corrugation pitch of about 100 mm, and is available on the market since it is typically used for channeling rain water through street drainage systems.

The edges 19 bear on respective aprons 23 which anchor the duct 13. As may be seen in FIG. 4 in particular, each apron 23 is a plate twice-folded in the longitudinal direction for providing an outer flat horizontal wing 25 having a width of about 70 mm for anchoring to the floor 43, by means of embedded bolts (not illustrated) which pass through holes 27, a middle wing or web 29, also flat, having a width of about 60 mm and extending vertically up to a height H29 slightly less than the top level H21 of the air outlet openings 21, and a third flat wing 31 having a width of about 70 mm. This third wing 31 is transversally slanted and forms a deflector extending in an inclined plane at about 45° into the channel 13.

The openings 21 are formed near the onset of each corrugation 17, that is a small distance after the zenith 33 in the direction A the grain is conveyed. Each opening 21 is formed by partly cutting the sheet 15 in the shape of an L-shaped slit 35 and folding the cut portion outwards to form a deflector 37 until it is slanted relative to the plane B of the duct 13, such that the angle formed therebetween of 30° to 60°, preferable of about 45°, or so that the deflectors are approximately parallel to the complementary slope 39 of the corrugations. Although the dimensions set forth hereinabove are subject to change depending on specific applications and parts availability, the cut-and-folded portions forming the deflectors 37 may measure 70 mm by between 5 and 25 mm according to the size of opening 21 required. The preferred placement of the openings 21 is on the trailing slope of each corrugation 17, approximately equidistant between the zenith 33 and the next inflexion 34 of the sine-wave corrugations, in the bulk-material conveyance direction A.

Figure 4:
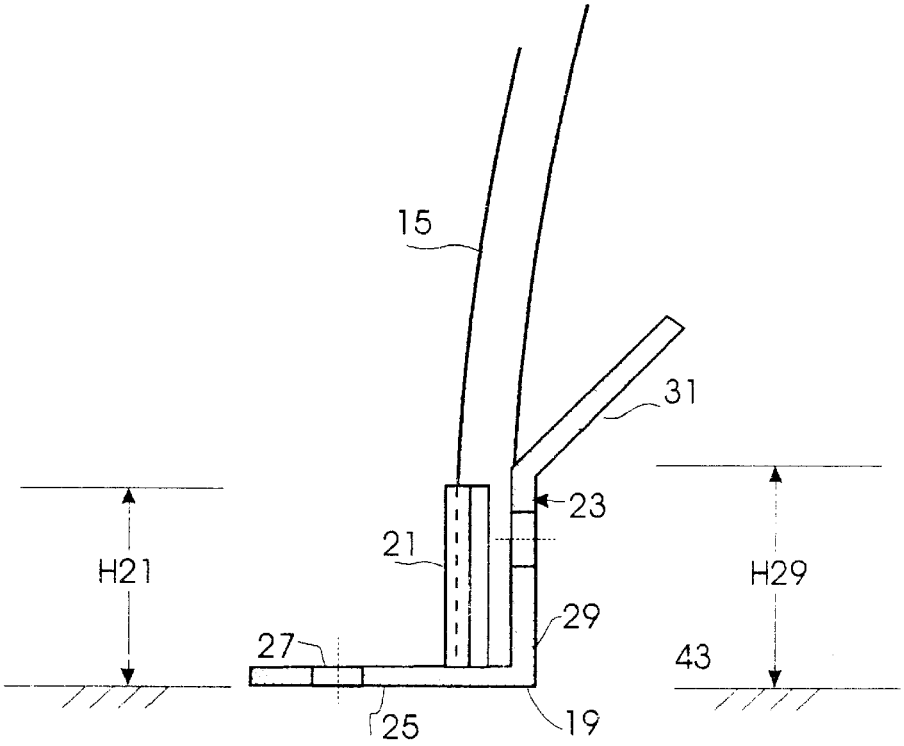
FIG. 4 is a magnification of the left edge of the apparatus of FIG. 1, showing one of the aprons for anchoring to the floor.
Figure 3:
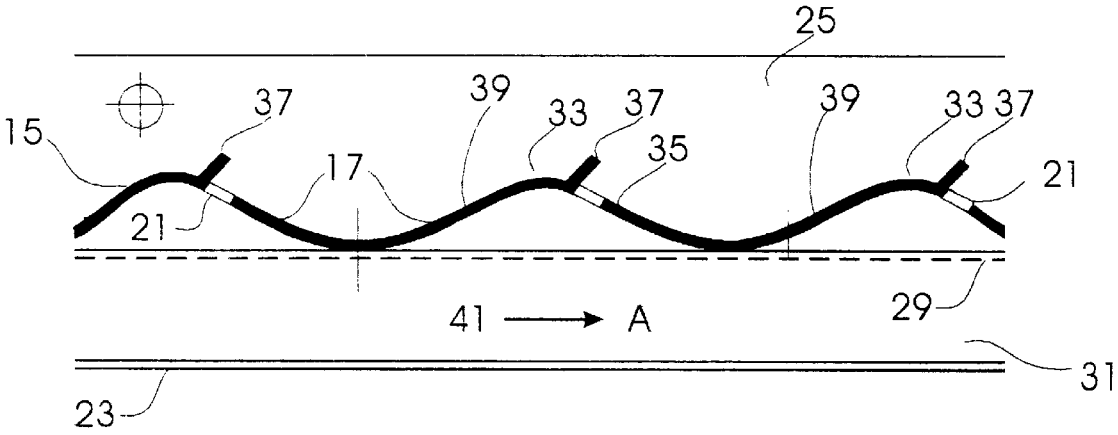
FIG. 3 is a longitudinal section of the stretch of apparatus shown in FIG. 2, illustrating the corrugation of the sheet of the duct and the placement and formation of the openings.

As specified when describing FIG. 1, the cross section of the cilindered sheet 15 is designed to be an exact half-circle so that the longitudinal edges 17 bear vertically on the outer wings 25 of the aprons 21, as depicted in FIG. 4, forming a relatively tight seal against air escaping therethrough. The vertical wing 29 bears against the inner corrugated surface of the duct 13, forming outlet channels 41 having a cross-section less than a half circle each, as seen in FIG. 3, which terminate at the openings 21.

All component parts 15 and 23 of the assembly 11 are preferably made from galvanized SAE 1010 steel.

Figure 5:
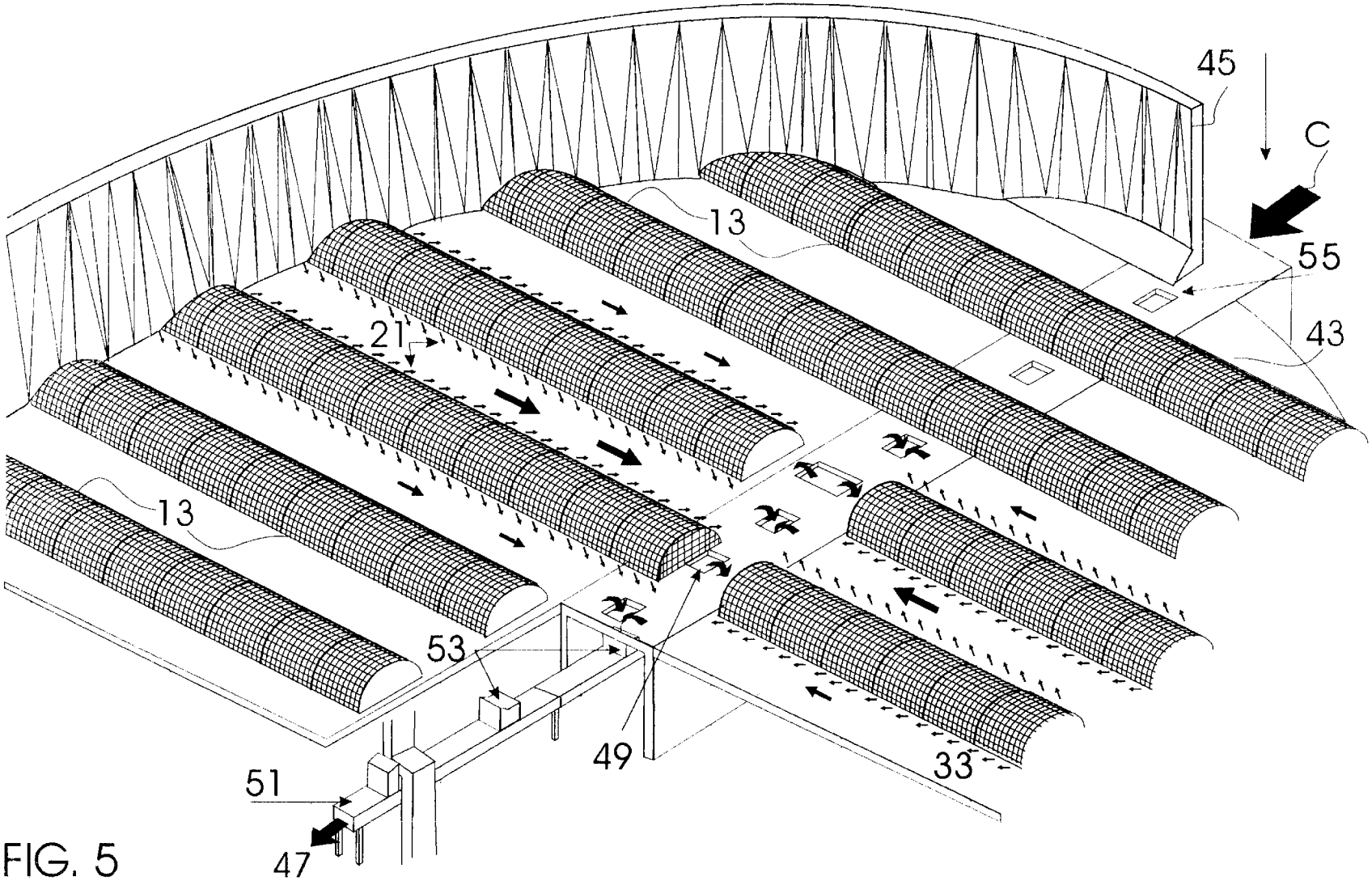
FIG. 5 is a perspective view of a portion of a depot to illustrate an application of the apparatus of the invention.

FIG. 5 illustrates the installation of the airing apparatus 11 of the invention on the floor 43 of a silo 45 which is depicted partially cut away for visibility sake. A plurality of ducts 13 are supported on the floor 43, parallel to one another and perpendicular to a diametrical axis 47. Some of the ducts are schematically shown cut away in the middle to illustrate how air is injected thereinto through inlets 49 formed in the floor 43 in line generally with the axis 47 and connected to a fan (not illustrated) which injects air under the floor 43 as indicated by the arrow C. The fan may be further associated to air-conditioning means (not illustrated) for heating or cooling or otherwise controlling the temperature of the air blasted into the grain in storage in the silo 11. The ducts 13 are placed so that the director openings 21 point towards the middle 47.

The floor 43 has been partly cut away at the lower middle part of FIG. 5 to reveal the conveyor for extracting grain 51 connected to discharge outlets 55 coaxial to said axis 47 by means of unloading valves 53 for providing selective control of the different silo areas 45 to be emptied.

Of course, a preferred embodiment has been disclosed in detailed hereinabove but which is open to changes without departing from the purview of the invention as set forth in the appended claims.

I claim:

1. An apparatus for airing grains stored in bulk on a floor of a depot, the apparatus comprising:

a duct for placing on said floor where it may be covered by grain in storage, and apron means for anchoring said duct to said floor;

wherein said duct:

has an inner surface, an outer surface and two longitudinal edges, said longitudinal edges extending substantially parallel to one another and bearing on respective ones of said apron means, is connected to be supplied with air from blower means, is provided with outlet openings for injecting said air into said grains, said openings located adjacent or near to said longitudinal edges of the duct, and is made of half-cilindered corrugated sheet featuring transversal substantially sine-waveform reinforcement corrugations;

each of said apron means includes:

a substantially horizontal wing for anchoring onto said floor thereby forming an air channel between said floor and the inner surface of the duct and a second wing extending perpendicular to the horizontal wing up to a level at least approximately equal to the level of said air outlet openings;

and wherein the cross section of each duct sheet is a half-circle such that said duct longitudinal edges thereby bear perpendicularly on said respective horizontal wings of said aprons.

2. The apparatus of claim 1, wherein said apron further comprises a third wing extending from a top longitudinal edge of the second wing and in a slanted plane inwardly to said channel.

3. The apparatus of claim 1, wherein said openings are formed at the onset of each corrugation in the direction the grain is conveyed upon discharge from the depot.

4. The apparatus of claim 1, wherein said openings are formed by cutting L-shaped portions in the sheet and folding the cut portions outwardly to form respective deflectors at a predetermined angle to the wall of said duct.

5. The apparatus of claim 4, wherein said angle is between 30° and 60°.

6. The apparatus of claim 5, wherein said angle is about 45°.

7. The apparatus of claim 4, wherein said deflectors are folded out to become approximately parallel to the complementary slope of said corrugations.

8. The apparatus of claim 1, wherein said apron wings are substantially flat.

9. The apparatus of claim 1, wherein said apron second wing is in substantial contact with said internal duct surface at the low point of said corrugations thereby forming between successive intercorrugation contacts respective pressurized air channels extending towards respective ones of said openings.

10. The apparatus of claim 1, wherein said fan is furthermore associated to air-conditioning means for controlling the temperature of the air supplied through said duct.

11. The apparatus of claim 10, wherein said air-conditioning means includes heater means.

12. A silo for storing grains in bulk, said silo including a floor, a side wall, and an apparatus installed on said floor for airing said grains, said apparatus including air blower means and a plurality of air ducts connected to said air blower means and anchored to said floor by respective aprons, wherein each one of said ducts:

has an inner surface, an outer surface whereon said grain may form a pile and two longitudinal edges, said longitudinal edges extending substantially parallel to one another and bearing on respective ones of said apron means, is connected to be supplied with air from blower means, is provided with outlet openings for injecting said air into said grains, said openings located adjacent or near to said longitudinal edges of the duct, and is made of half-cilindered corrugated sheet featuring transversal substantially sine-waveform reinforcement corrugations;

each of said aprons includes:

a substantially horizontal wing for anchoring onto said floor thereby forming an air channel between said floor and the inner surface of the duct and a second wing extending perpendicular to the horizontal wing up to a level at least approximately equal to the level of said air outlet openings;

and wherein the cross section of each duct sheet is a half-circle such that said duct longitudinal edges thereby bear perpendicularly on said respective horizontal wings of said aprons.

* * * * *